United States Patent [19]

Schladitz et al.

[11] Patent Number: 4,907,137

[45] Date of Patent: Mar. 6, 1990

[54] APPARATUS FOR SUPPORTING A LAMP ON A LOW-VOLTAGE RAIL

[75] Inventors: Klaus Schladitz, Endorf; Rolf Winter, Renkenweg 3b, DE-8210 Prien, both of Fed. Rep. of Germany

[73] Assignee: Rolf Winter, Fed. Rep. of Germany

[21] Appl. No.: 198,785

[22] Filed: May 25, 1988

[30] Foreign Application Priority Data

May 30, 1987 [DE] Fed. Rep. of Germany ... 8707756[U]

[51] Int. Cl.[4] ..... F21S 1/02

[52] U.S. Cl. ..... 362/145; 362/147; 362/226; 362/421; 362/294; 439/110

[58] Field of Search ..... 362/145, 147, 226, 421, 362/294, 148, 150; 439/110, 111, 792

[56] References Cited

FOREIGN PATENT DOCUMENTS

G8633279.1 5/1930 Fed. Rep. of Germany .

*Primary Examiner*—Ira S. Lazarus
*Assistant Examiner*—Sue Hagarman
*Attorney, Agent, or Firm*—Orrin M. Haugen; Thomas J. Nikolai; Frederick W. Niebuhr

[57] ABSTRACT

An adjustable neck is provided for adjusting a lamp, in particular a lamp plugged onto a low-voltage rail, in as many alternative directions as possible. The adjustable neck is mounted between a clamping socket of the lamp and the replaceable incandescent body or bulb. The adjustable neck includes several joint members, each consisting of a ball portion that can be plugged into a corresponding joint seat portion of a next adjacent joint member and held there by a friction fit. The incandescent body can be surrounded by a lamp shade provided with ventilating slots. The clamping socket is embodied such that a positive anchoring is achievable even in the case of larger, heavier lamps.

21 Claims, 2 Drawing Sheets

APPARATUS FOR SUPPORTING A LAMP ON A LOW-VOLTAGE RAIL

BACKGROUND OF THE INVENTION

This invention relates to an electrical lamp, and means for plugging the lamp into a low-voltage rail having a central longitudinal portion or track, and intermittent transverse portions supporting longitudinal side strips spaced apart from the track on opposite sides of it.

Extendable voltage rails, for use in supplying alternating current to electrical lamps at an appropriate voltage (e.g. 220 volts), are known to afford variable lighting arrangements for office spaces, display windows and the like. Lights of different design, but in particular halogen lamps, can be clamped along the voltage rail at random locations, depending upon lighting requirements. The clamping procedure provides both the mechanical support and the electrical contact. Because of possible danger from the high voltage, the voltage rail and light clamping socket must include safeguards against direct contact with current carrying structure.

These lights are relatively large and heavy, such that the mechanical support must be correspondingly strong. Consequently, clamping sockets or other clamping connectors are expensive, complex and therefore costly.

German Pat. No. (DE-GM 86 33 279) discloses a low-voltage rail for supporting miniature lamps when clamped onto the rail. The rail is plastic, and includes a longitudinally running central part or track, and two side rails parallel to the central track. Intermittent cross-pieces or lateral portions support the side rails at a selected distance from the central track. Free-lying, bare conductor wires are placed or clipped in and held on the cross-pieces, and run longitudinally along the two spaces between the central track and side rails. Miniature, low-voltage lamps can be plugged into the clamping socket with the two connecting wires projecting out from the miniature lamps capable of being plugged in through the socket. The socket base, with two connecting wires plugged through, has socket support surfaces that lie against the conductor wires of the rail, with interposition of the clamp connecting wires to form an electrical contact. Two socket support surfaces or fork-shaped walls face one another to grip the central track and provide the mechanical support.

These miniature lamps, however, are firmly seated with their sockets and are limited to adjustment on the low-voltage rail in the longitudinal direction. This unduly restricts the directions in which illumination is possible. Additionally, the miniature lamps and their sockets comprise very small parts of low mass that project only slightly past the low-voltage rail. Because of this, they afford relatively little support. Therefore, the support is not strong enough for larger and heavier plug-in lights, in particular for low-voltage halogen lamps having an integral reflector and an extension piece or neck. The increased forces and pitching moments are too demanding for the conventional structure to provide sufficient support.

An object of the present invention is to provide a lamp, in particular a lamp capable of being plugged onto a low-voltage rail and adjustable over a wide range of different beam directions. Another object is to provide a lamp shade suitable for accommodating a reflector and that can properly dissipate the heat coming from the reflector. The heat loading of the entire lamp must be as little as possible so that practically all lamp parts (up to the lamp and possibly the reflector, along with other nonessential protective parts) can be injection molded from plastic. The lamp must be mechanically simple in design, and able to be produced in cost-effective fashion with the aid of known plastic injection molding techniques. Finally, another object of the invention is to provide a lamp capable of being plugged onto conventional low-voltage rails. In particular, the lamp should have a clamping socket that forms the electrical connection as well as a good mechanical support, with the lamp capable of being clamped and displaced at numerous arbitrary locations along the low-voltage rail.

SUMMARY OF THE INVENTION

The object is met in accordance with the invention by providing in a lamp, between its clamping socket and the replaceable incandescent bulb, an extension part or neck consisting of a plurality of serially connected joint members, each having a ball portion and a joint seat portion, with the individual ball end of each joint member held in the joint seat portion of an associated one of the joint members in a friction fit. Each of the ball portions includes a bore therethrough to provide a passage within the neck for lamp connecting wires. Advantageous embodiments of the invention are defined in the dependent claims.

The lamp in accordance with the invention permits an arbitrary setting of the direction of radiation over wide ranges. This is made possible by an extension part or neck provided between the clamping socket and the lamp shade and consisting of ball joint parts plugged into one another. These ball joint parts have a friction fit so that they are actually rotatable against one another, while their spatial relation is retained. The lamp shade and the clamping socket have corresponding connecting parts. All ball joint parts are bored through so that the lamp connection wires can be fed through to the clamping socket.

Of course, the ball joint parts should have a clamping force sufficient so that a lamp orientation corresponding to a preset direction of radiation will be maintained even when the forces of gravity are acting on the adjustable neck.

In a further development of the invention, each of the ball joint parts can be provided with a spring-groove catch. The catch is preferentially formed by at least one, and preferably two oppositely lying longitudinal slots constructed in the seat portion and positioned to engage a radial pin fixed on the associated ball portion. Because of these spring-groove catches, a fully random adjustment of the direction of radiation is obtained, yet the lamp cannot be rotated along the neck repeatedly when resetting. The electrical wires inside the ball joints thus cannot be twisted around about themselves to damage and possibly break them.

Another embodiment of the invention based on claim 9 concerns the lamp shade. The lamp shade contains a reflector which, particularly when using bright halogen lamps, becomes very hot. It is therefore proposed to produce the lamp shade of concentrically disposed, ring-shaped cylinder parts or rings, with a ventilating slot being formed between each two adjacently lying rings. The rings are serially offset in the axial direction and joined by cross-pieces, so that resulting overall form is conical. This lamp shade enables use of a shade formed of plastic by injection molding, which can withstand only a certain maximum temperature, as the heat of the reflector is properly dissipated. Heat dissipation occurs in favorable fashion, opposite to the direction of light radiation, whereby irradiated parts, for example in a display window, will not be heated to an unallowable degree. This avoids undesirable heating of irradiated parts leading for example to spoilage of foodstuffs to changes in color of fabrics, and even to combustion of heat sensitive parts. In practice, a filter disk is disposed in front of the reflector.

According to claims 10 and 12, respectively, the incandescent body is advantageously plugged into a socket, integral with or independently of the reflector, and held there. This simplifies installation and replacement of the lamp and/or of a reflector.

In order to guarantee adequate clamping forces for supporting heavier lamps, the clamping socket of the lamp contains two clamping pieces each having two longitudinally running walls, so that the clamping pieces are fork-shaped in cross-section. These clamping pieces are plugged onto a side strip in form-closure fashion so that the longitudinal side surfaces of the clamping pieces lie against the longitudinal side surfaces of the side strips and grip about them in fork-fashion. The inner sides of the two clamping pieces facing toward one another are spaced apart a distance approximately equal to the distance between the bare (uninsulated) conductor wires of the low-voltage rail, so that plugging the lamp and the clamping socket onto the low-voltage rail provides a good mechanical support and positive electrical contact to the lamp connection wires. By means of the firm, mechanical support, even relatively heavy lamps with a lamp shade projecting far out from the low-voltage rail can be reliably supported. This firm and reliable FIG. 7 is a vertical sectional view of a lamp with reflector that is capable of being installed in a lamp shade and a socket.

DETAILED DESCRIPTION OF THE PREFERRED EMBODIMENT

Represented in FIG. 1 is a plug-in lamp 1 that consists of a lamp shade 2, a clamping socket 3 and an extension part or neck 4. The lamp 1, particularly the clamping socket 3, is clamped onto a low-voltage rail 5. Particulars of the low-voltage rail 5 and of the clamping socket 3 are described in connection with FIG. 3.

The neck 4 consists of ball joint parts or joint members 6 each consisting of a ball portion 9 and of a joint seat portion 8. The individual joint members 6 are connected to one another in series depending upon the desired length of neck 4 and are held in the set position by friction fit. Installed at the base of the lamp shade as a connector to the extension part is a ball portion 9, and installed at the clamping socket 3 is a joint seat portion 10.

The lamp shade 2 consists of ring-shaped cylinder parts or rings 11 to 14 that are disposed concentrically and between which are formed ventilation slots 15. The rings 11 to 14 are serially offset in the axial direction to provide overall a tapered or truncated conical shape. Rings 11 to 14 are joined by cross-pieces or braces 16.

The base 17 of the lamp shade 2 is constructed as a plug-in socket for the lamp and if desired can accommodate a reflector with the lamp, with lamp connection wires being fed through openings 18, through the neck 4, to the clamping socket 3. support is maintained, even in the event of vibrations, as the lamps do not become loose from the rail. Persons or objects underneath avoid injury from the lamps due to their weight or their high operating temperatures.

The supporting mechanism can be further improved by clamping pieces that are held pressed against the side strips and the conductor wires by biasing action.

Prongs with back tapers and hooks or barbs can be provided for an additional improvement of the support.

IN THE DRAWINGS

To be explained now with the aid of drawings are embodiments with further particulars, features and advantages. Shown in particular in:

Figure 5:
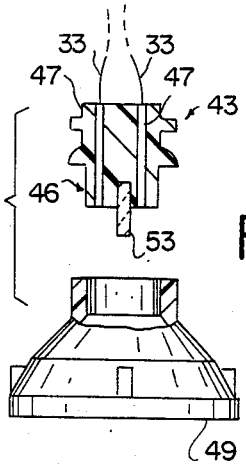
FIG. 5 is an axial section through a reflector that can be installed in the lamp, along with an associated socket with a lamp that can be plugged therein, without the associated lamp shade.
Figure 6A:
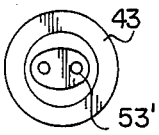

FIG. **6*a* is a top view of a socket modified as compared to that in FIG. 5**, with the lamp and incandescent bulb removed;

FIG. **6*b* is a vertical sectional view of the modified embodiment based on FIG. 6*a*; and The forward rim of the reflector is held by nose pieces or enlarged ends 19 on the braces 16**.

Figure 3:
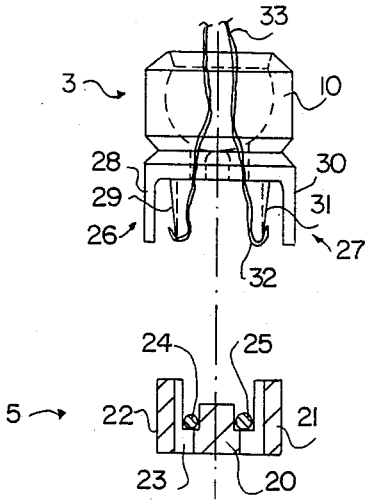
FIG. 3 is a clamping socket for the lamp, removed from a low-voltage rail represented in cross-section.

The lower part of FIG. 3 shows a cross-section through the low-voltage rail 5, with a longitudinally running central part or track 20, longitudinal side strips 21 and 22, along with cross-pieces or transverse supports 23. Clipped in on the cross-pieces are bare conductor wires 24, 25.

The top part of FIG. 3 shows a clamping socket 3 (without neck 4) removed from the low-voltage rail. The clamping socket 3 includes joint seat 10. Formed in the lower part of the clamping socket, on its left and right sides, are clamping pieces 26 and 27. Each clamping piece, in turn, includes two longitudinally running walls (28, 29, and respectively 30 and 31). Clamping fingers define outer walls 28 and 30. Inner walls 29 and 31 facing toward one another are defined by flexible, spring-like prongs with hooks or barbs 32 formed at their bottom ends.

Two connecting wires 33 extend through the clamping socket 3, at joint seat portion 10, downwardly (as viewed in FIG. 3) along the outside of the inner walls 29 and 31, and clamped in and bent about on their undersides in slots provided therefor.

The arrangement represented in FIG. 3 has the following function:

When placing the clamping socket 3 on the low-voltage rail 5, the clamping pieces 26 an 27 grip side strips 21 and 22 respectively of the low-voltage rail 5, with their walls 28 and 29, and 30 and 31, in conforming closure fashion to create a restoring force to enhance gripping. At the same time, the connecting wires 33, which are run bare (without insulation) in the region of the walls 29 and 31, are brought into contact with the conductor wires 24, 25 and pressed thereagainst, whereby good electrical contact is obtained. The conductor wires 24 and 25 grip under the walls 29 and 31 with the hooks 32, so that there results a good support, in addition to the support of the clamping pieces against the side strips 21, 22.

Summarizing, the invention affords a low-voltage rail with a plug-in lamp with simple construction, good functioning and a wide variety of applications.

Figure 4:
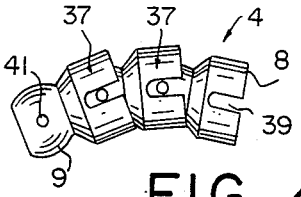
FIG. 4 is a side view of a modified, adjustable extension part or neck of the lamp between the lamp shade and clamping socket.

Shown in FIG. 4 is a variant, in that the ball joint members 6 are each additionally provided with a spring-groove catch 37 for the purpose of preventing relative rotation about their longitudinal axis. By this means, repeated adjustments of the lamp do not twist the connecting wires 33 which, in the extreme case, could break the wires.

In the embodiment shown, the spring-groove catch 37 consists of two longitudinal slots 39 in each of the joint seat portions 8, 10 that are open toward the open or ball portion insertion region of the joint seat, into which a radial pin 41, that projects out from both sides of the associated ball portion 9, is engaged and contained. The free adjustability of the lamp is not impaired by this. The joint seat portions 8, 10 can be produced with just one longitudinal slot 39 therein. However, with two opposed slots 39, two joint seat finger-like parts are formed in each joint seat portions 8, 10, permitting elastic bending of the fingers such that they act with a greater biasing or restoring force (i.e. by force on the ball portion 9 placed therein) and therefore grip about the ball portion more firmly.

A dropping down of the lamp into an undesired radiating direction is positively avoided by this, even in the case of heavy lamps.

As shown in FIG. 5, the lamp shade need not be provided with a firmly integrated lamp socket for plugging in an incandescent body 45 or bulb. Rather, the lamp shade 2 is capable of being plugged in as a separate component into the lamp socket 43 that is represented in FIG. 5 and produced separately. Additionally, provided in the lamp shade base plate 17 is an appropriate recess with which the lamp shade can be plugged into the lamp socket 43 represented in FIG. 5. The lamp socket 43 is the last part in the adjustable neck 4, wherefor, in the embodiment shown, it still has a ball portion 9 with two oppositely lying, radially extending pins 41 for the spring-groove catch 37.

Figure 1:
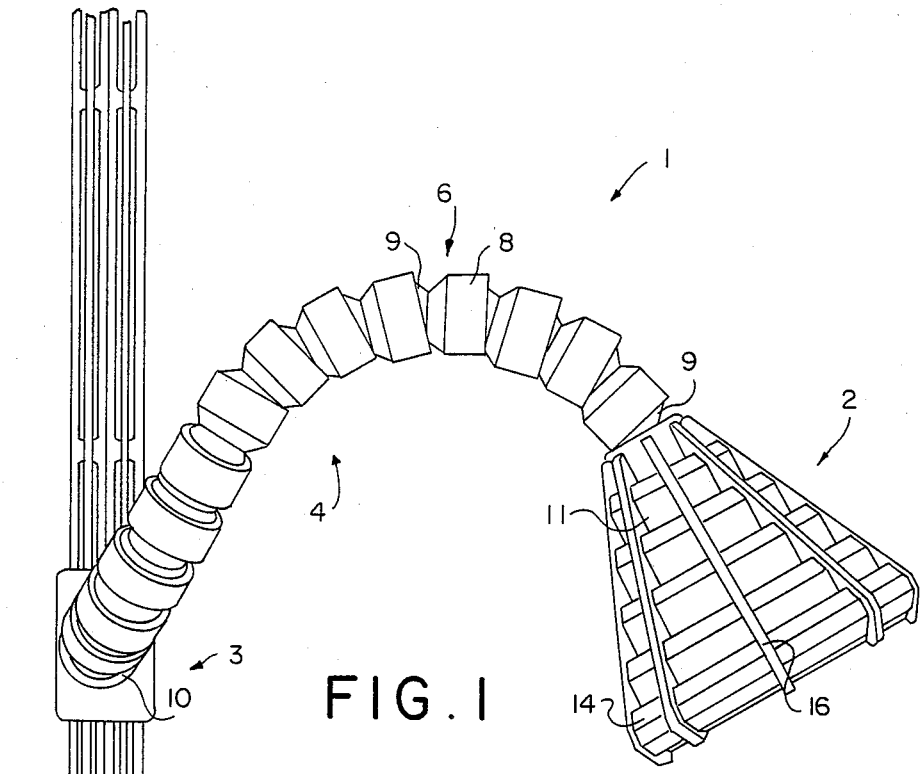
FIG. 1 is a low-voltage rail with plugged-in lamp, in a perspective view.
Figure 2:
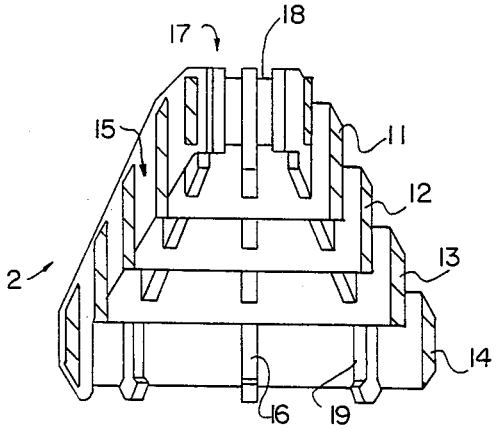
FIG. 2 is an axial cut through a lamp shade.

After the lamp shade 2 represented in FIG. 2 is plugged, through its opening in the base plate 17, into a corresponding extension or add-on piece 46 on the lamp socket 43, the separate reflector 49 shown schematically in FIG. 5 can still be plugged into the lamp shade 2, and held there by the enlarged ends 19. Finally, an incandescent body 45 such as that shown in FIG. 7 can then be plugged in, with or without the reflector 49. That is, its two connecting pins 51 can be introduced into the lamp socket 43 that additionally has two cap sleeves 47. The cap sleeves 47 are joined with the conductor wires 24 and 25 respectively via the two connecting wires 33 inside neck 4.

When a bulb fails, only the incandescent body 45 needs to be replaced, i.e. it is removed from the lamp socket 43 and replaced by a new one. In doing this, the reflector 49 can remain in the lamp shade 2.

Figure 7:
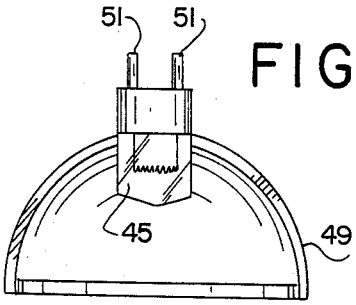

Deviating from the embodiment in accordance with FIG. 5, shown in FIG. 7 is an alternative, insofar as here the incandescent body 45 is produced with its own reflector 49 and two connecting wires as a common component. In the case of this form of construction, the unit consisting of the incandescent body 45 and the reflector 49 is plugged into the lamp shade 2 and the associated lamp socket 43, with the two connecting pins 51 engaging into the two cap sleeves formed in two longitudinal borings, for producing an electrical connection. In FIG. 7, the incandescent body 45 and reflector 49 are shown without the plugged in lamp socket 43.

By back-ventilating the lamp shade, heat is dissipated such that the plastic is not damaged. It is only in the immediate vicinity of the incandescent body, primarily adjacent the base of the lamp socket 43, that heat might occur. A certain minimum spacing between incandescent body 45 and lamp socket 43 can be provided by a spacer 53 in the form of a pin, as is represented in FIG. 5. Spacer 53 consists, for example, of ceramic and is introduced into an appropriate vertical pocket or sleeve in the lamp socket 43, from which it extends on the lamp or bulb side. When plugging in the associated incandescent body 45, i.e. when plugging its connecting pins 51 into the cap sleeves 47, the maximum plug-in depth of the incandescent body 45 is limited when it contacts spacer 53.

Figure 6B:
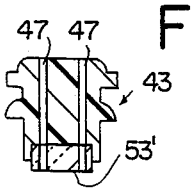

Represented in FIGS. 6*a* and 6*b* is an alternative. Instead of the pinform spacer 53, an oval spacer 53' is provided. Spacer 53' has two aligning longitudinal borings within which or behind which the cap sleeves 47 are located. It is through these borings that the two connecting pins 51 of the incandescent body 45 are received. Thus, the highest heat occurring proximate the incandescent body cannot damage the lying plastic, as the ceramic maintains the plastic spaced apart from the socket base.

What is claimed:

1. A lamp removably mounted to a low-voltage rail, said rail consisting of a longitudinally running central track, two side strips running parallel to said track, a transverse support means for supporting said side strips in spaced apart relation to the central track on opposite sides thereof, and a plurality of at least partially free-lying, bare conductor wires running longitudinally between the central track and the side strips, characterized in that:

said lamp includes a clamping socket removably mounted to the rail, a plug-in socket means for supporting a replaceable incandescent body, an adjustable neck between said clamping socket and said plug-in means, and connecting wires for electrically joining said plug-in socket means and conductor wires, said adjustable neck including a plurality of serially connected joint members, each said joint member having a ball portion and a joint seat portion at its opposite ends, said joint members being serially connected to one another to form said neck, with the ball portion of each joint member being substantially surrounded by the joint seat portion of an associated, next adjacent joint member and held in a frictional engagement that provides a clamping force sufficient to maintain said joint member and said next adjacent joint member in a set position with respect to one another, and means forming borings through said joint members for accommodating said connecting wires.

2. The lamp according to claim 1, further characterized in that one of said joint seat portions is formed as an integral part of the clamping socket and so engaged with one of the joint members said neck, and one of said ball portions is formed as an integral part of said plug-in socket means and so engaged with another of the joint members of said neck, said plug-in socket means including integral lamp shade and socket portions.

3. The lamp according to claim 1, further characterized in that one of said joint seat portions is formed as an integral part of said clamping socket and is so engaged with one of the joint members of said neck, and further in that one of said ball portions is formed as an integral part of said plug-in socket means and so engaged with another of the joint members of said neck, accommodating said incandescent body.

4. The lamp according to claim 1, further characterized in that said joint members include a means for preventing the joint members from rotating relative to one another about their longitudinal axis.

5. The lamp according to claim 4, further characterized in that said means for preventing rotation consists of at least one spring-groove catch between each ball portion and its associated joint seat portion.

6. The lamp according to claim 5, further characterized in that the spring-groove catch consists of at least one longitudinal slot in each joint seat portion and positioned to engage an associated pin extended radially outwardly of an associated ball portion so engaged with the seat portion, with the remainder of the associated seat portion gripping about the associated, inserted ball portion with a restoring force.

7. The lamp according to claim 6, further characterized in that the longitudinal slot is open toward an insertion region of the joint seat portion for receiving the ball portion of its associated joint member.

8. The lamp according to claim 6, further characterized to include at least two opposed longitudinal slots in each of said joint seat parts and one of said radially extended pins engaged with each slot, said slots in each joint seat portion forming in their associated joint seat portion two finger-like parts which grip their associated ball portion with a restoring force.

9. The lamp according to claim 2, further characterized in that said joint members include a means for preventing said joint members from rotating relative to one another about their longitudinal axis.

10. The lamp according to claim 9, further characterized in that said means for preventing rotation consists of at least one spring-groove catch between each ball portion and its associated joint seat part portion.

11. The lamp according to claim 10, further characterized in that the spring-groove catch consists of at least one longitudinal slot in each joint seat portion and positioned to engage an associated pin extended radially outwardly of an associated ball portion so engaged with the seat portion, with the remainder of the associated seat portion gripping about the associated, inserted ball portion with a restoring force.

12. The lamp according to claim 11, further characterized in that the longitudinal slot is open toward an insertion region of the joint seat portion for receiving the ball portion of its associated joint member.

13. The lamp according to claim 11, further characterized to include at least two opposed longitudinal slots in each of said joint seat parts and one of said radially extended pins engaged with each slot, said slots in each joint seat portion forming in their associated joint seat portion two finger-like joint seat parts which grip their associated ball portion with a restoring force.

14. The lamp according to claim 1, further characterized to include a lamp shade accommodating the incandescent body and joined to said neck, said lamp shade consisting of a plurality of concentrically disposed rings, and a ventilating slot formed between each pair of adjacent rings, said rings lying successively offset in the axial direction to define a truncated cone, said lamp shade further including a plurality of braces joining said rings.

15. The lamp according to claim 14, further characterized in that the smallest of said rings is integrally mounted to said plug-in socket means, said plug-in socket means including a lamp socket for supporting said incandescent body and including one of said ball portions connected to said neck.

16. The lamp according to claim 15, further characterized in that said plug-in socket means includes a lamp socket constructed as a component separate from said lamp shade, said lamp shade adapted to be removably mounted to said lamp socket.

17. The lamp according to claim 15, further characterized to include a reflector constructed separately from the incandescent body, said lamp shade including a means for removably supporting said reflector inwardly of and with respect to the lamp shade.

18. The lamp according to claim 16, further characterized in that the lamp socket is constructed of plastic, and a ceramic, heat insensitive spacer is mounted on a side of said socket proximate the incandescent body.

19. The lamp according to claim 1, further characterized in that the clamping socket removably mounted to the low-voltage rail side includes two clamping pieces, each clamping piece including means defining inner and outer longitudinally running walls whereby the clamping pieces are fork-shaped in cross-section, each clamping piece adapted for engaging one of said side strips in conforming closure fashion, said clamping socket including means defining a boring therethrough to accommodate said connecting wires that further run along said inner walls of the clamping pieces, said inner walls facing one another and spaced apart a distance corresponding substantially to the distance between the conductor wires.

20. The lamp according to claim 19, further characterized in that said connecting wires are fastened with respect to said connecting socket by a bending of said wires about the inner walls that face one another.

21. The lamp according to claim 19, further characterized in that the inner and outer walls are pressed and maintained against the side strips and the conductor wires with a restoring force.

* * * * *